US010484773B2

(12) United States Patent
Ma

(10) Patent No.: US 10,484,773 B2
(45) Date of Patent: Nov. 19, 2019

(54) SPEAKER BEARING ARRAY SOUND-CONDUCTING STRUCTURE AND HEADPHONE USING SAME

(71) Applicant: Bamdas Technology Limited, Kowloon (HK)

(72) Inventor: Hang Tat Ma, Kowloon (HK)

(73) Assignee: BAMDAS TECHNOLOGY LIMITED, Kowloon (HK)

( * ) Notice: Subject to any disclaimer, the term of this patent is extended or adjusted under 35 U.S.C. 154(b) by 0 days.

(21) Appl. No.: 16/010,146

(22) Filed: Jun. 15, 2018

(65) Prior Publication Data

US 2018/0367880 A1 Dec. 20, 2018

(30) Foreign Application Priority Data

Jun. 16, 2017 (CN) ..... 2016 1 0840847

(51) Int. Cl.
*H04R 1/10* (2006.01)
*H04R 1/40* (2006.01)

(52) U.S. Cl.
CPC ..... *H04R 1/1008* (2013.01); *H04R 1/1075* (2013.01); *H04R 1/403* (2013.01)

(58) Field of Classification Search
CPC ..... H04R 1/008; H04R 1/1075; H04R 1/403
USPC ..... 381/71, 371, 370, 374, 380, 310
See application file for complete search history.

(56) References Cited

U.S. PATENT DOCUMENTS 3,984,885 A * 10/1976 Yoshimura ..... H04R 1/1075 381/309
2003/0025614 A1* 2/2003 Kahn ..... G08G 5/0021 340/961
2008/0199018 A1* 8/2008 Chen ..... H04R 5/033 381/61
2010/0054508 A1* 3/2010 Yang ..... H04R 5/033 381/310
2015/0163584 A1* 6/2015 Huang ..... H04R 1/1091 381/370

* cited by examiner

*Primary Examiner* — Melur Ramakrishnaiah
(74) *Attorney, Agent, or Firm* — Muncy, Geissler, Olds & Lowe, P.C.

(57) ABSTRACT

Disclosed is a speaker bearing array sound-conducting structure, disposed in a headphone. The structure comprises: a plurality of speaker units provided in a front cavity of the headphone; a bearing disposed in the center of the plurality of speaker units, such that the plurality of speaker units are uniformly distributed around the bearing centered about the bearing on the same layer, so as to generate a middle channel that produces sound; a sound output opening disposed in the front cavity, so as to fix the plurality of speaker units, and to concentrate the sound in the bearing and then conduct the sound outward; and a baffle disposed behind the bearing, so as to control a conducting direction of the sound. Also disclosed is a headphone made from the speaker bearing array sound-conducting structure. Because the speaker bearing array sound-conducting structure of the present invention uses a special bearing array arrangement approach, the transmission channels of speaker units are created and controlled, so as to achieve the highest sound transmission efficiency and the best sound synchronization performance.

6 Claims, 8 Drawing Sheets

SPEAKER BEARING ARRAY SOUND-CONDUCTING STRUCTURE AND HEADPHONE USING SAME

TECHNICAL FIELD

The present invention relates to a sound production device, and more particularly to headphones having a good sound transmission effect.

BACKGROUND ART

The arrangement of sound production speaker units in existing headphone products mainly uses conventional matrix arrangement in general. It is required to conduct the sound of the speakers of the headphone into the ear in the design of a headphone, and therefore, the shapes of the front cavity parts of all headphones are like a funnel. However, the funnel-shaped structure causes a bottleneck with a wide upper part and a narrow lower part to the matrix-arranged speakers, thus affecting the overall sound transmission efficiency.

For example, for the speakers directly facing a funnel-shaped outlet, because the speakers and the sound output opening are connected in a line, the sound transmission distance is the shortest and the sound transmission efficiency is the highest; while for the speakers arranged at two sides, because of the shape of the front cavity with a wide upper part and a narrow lower part, a local deformation is caused, thus achieving a different effect. The effect may be an increased sound transmission distance, and may be a sound attenuation or individual frequency effect caused by a decreased and deformed transmission space. Therefore, the sound performance consistency of the speakers is poor, and the maximum or ideal effects of the respective speakers cannot be achieved.

For some headphone products where a plurality of speakers are built in, in the inner structure, an independent sound-conducting pipe made of a soft or hard material is configured for individual speaker units or speaker groups, the individual speaker or the speaker groups are connected by independent pipelines with a particular size, and the sound of all the speakers is concentrated to the sound output opening of the front cavity of the headphone by the pipeline, so as to satisfy sound transmission requirements of different speakers. FIGS. 1 and 2 show schematic diagrams of the boundary structures of the inner structures of two conventional headphones. The headphones in the schematic diagrams each comprise a plurality of speaker units 10 (three speaker units, i.e., speaker units 1, 2 and 3, in the schematic diagrams), which are arranged in the headphone. During sound production, the sound transmission is affected due to an inner arrangement problem. For example, for the regions 110 in the schematic diagrams, because of the difference in the shapes thereof, an obvious local deformation is caused, thus different effects are caused to the sound transmission, and the effects of the transmitted sound are not good.

However, the lengths or shapes of the independent pipelines are not the same, thus different effects are also caused to the individual speakers or the speaker groups. For instance, the inner spaces of straight and bent conductor pipes are not the same. In the same speaker group, individual speakers share a straight range and individual speakers share a surrounding range. Different effects are also caused to speakers under the limitation of the different overall ranges of the conductor pipes when the same group of speakers performs transmission. The sound transmission efficiency of individual speakers may be greatly reduced if the edges of the pipelines and the speakers form narrow ranges. In addition, the design of using independent conductor pipes is limited by the overall size of the individual speakers, while more speaker units cannot be increased in the cavity of the headphone, thus improving the overall effect. For example, for the front cavity of a circular speaker with an inner diameter of only 5 mm, physically, it is impossible to use a conductor pipe with an outer diameter of 5 mm or more. That is to say, the original effective sound transmission space and route of the front cavity with the inner diameter of 5 mm is limited by the size of the independent pipelines, so as to reduce the original transmission space, thus greatly reducing the transmission efficiency.

Therefore, it is urgently required to improve the prior art, so as to obtain a transmission structure having high transmission efficiency and a good sound effect, thereby satisfying the spiritual life requirements of people.

SUMMARY OF THE INVENTION

One purpose of the present invention is to overcome the shortcoming of the prior art. Provided is a novel structure of arranging speaker units in a headphone and a headphone using the structure. By using the structure of arranging speaker units, the sound transmission efficiency of a headphone and the sound output quality can be greatly improved.

To achieve the purpose, the present invention uses the following technical solution:

A speaker bearing array sound-conducting structure, disposed in a headphone, wherein the speaker bearing array sound-conducting structure comprises:

a plurality of speaker units, disposed in a front cavity of the headphone;

a bearing, disposed in the center of the plurality of speaker units, such that the plurality of speaker units are uniformly distributed around the bearing centered about the bearing on the same layer, so as to generate a middle channel that produces sound;

a sound output opening, disposed in the front cavity, so as to fix the plurality of speaker units, and to concentrate the sound in the bearing and then conduct the sound outward; and a baffle, disposed behind the bearing, so as to control a conducting direction of the sound.

According to the speaker bearing array sound-conducting structure of the present invention, the baffle is disposed in a total-enclosed type or semi-enclosed type, so as to control the conducting direction of sound or the overall conducted sound strength or frequency integrity or to connect other external parts and structures.

According to an embodiment of the speaker bearing array sound-conducting structure of the present invention, the plurality of speaker units are arranged quadrangularly or circularly.

Further, according to an embodiment of the speaker bearing array sound-conducting structure of the present invention, the number of the speaker units is four. According to an embodiment of the speaker bearing array sound-conducting structure of the present invention, the number of the speaker units is eight. Of course, the number of the speakers can be determined by rotation according to needs, so as to satisfy different requirements.

According to an embodiment of the speaker bearing array sound-conducting structure of the present invention, the speaker bearing array sound-conducting structure comprises a driver, disposed behind a back plate.

The present invention also provides a headphone. The headphone comprises a front cavity and a back cavity, wherein the headphone further comprises the speaker bearing array sound-conducting structure, so as to obtain sound having a consistent sound effect.

Compared with the prior art, the beneficial effects of the present invention comprise:

The speaker bearing array sound-conducting structure of the present invention uses a special bearing array arrangement approach. By means of the arrangement where the middle bearing is surrounded by the same layer of speakers, so as to generate a middle channel, in coordination with the sound output opening in front and the totally or partially closed baffle behind, the transmission channels of the speakers are created and controlled. The speakers share the bearing channel with the same size, and therefore, the transmission distances and spaces of all the speakers on the same layer are the same. The highest transmission efficiency and the best sound synchronization performance are achieved. The problems of different transmission distances, paths and efficiency of matrix arrangement and funnel shape with a wide upper part and a narrow lower part are solved. The problem of an effect on the sound transmission efficiency of individual or all speakers caused by different sizes and spaces of the independent pipelines of the individual speakers or the speaker groups during matrix arrangement is solved.

Further, in the arrangement of the speaker units of the present invention, a plurality of speakers can be arranged in one-layer structure and it is ensured that all speakers can share transmission channels with the same size, so as to ensure the highest sound output efficiency, path consistency and time synchronization of the speakers on the same layer. Moreover, the speakers on the same layer can use designs of different characteristics, so as to achieve the purpose of automatically adjusting sound or improving the sound effect.

In addition, the arrangement structure of the present invention can be achieved by means of same-layer stacking or matching among structures of different designs. Even if the structures are different, after stacking, transmission channels with the same size and space can still be shared, so that the limitation is broken and the overall effect is improved.

DETAILED DESCRIPTION OF THE INVENTION

Below, further detailed descriptions on the present invention are made in combination with the drawings and specific embodiments.

Figure 1:
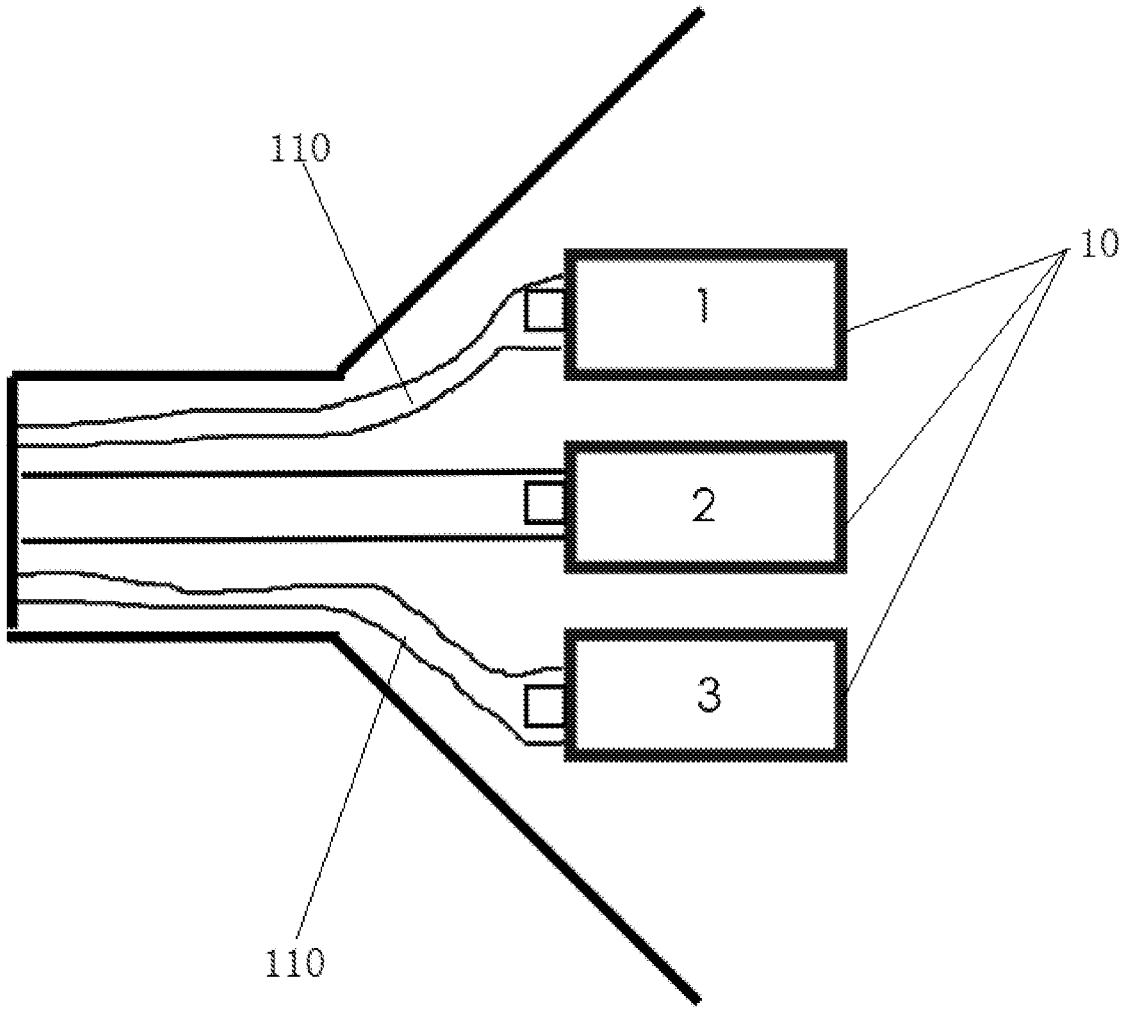
FIG. 1 shows a schematic diagram of the boundary structure of the inner structure of a headphone.
Figure 2:
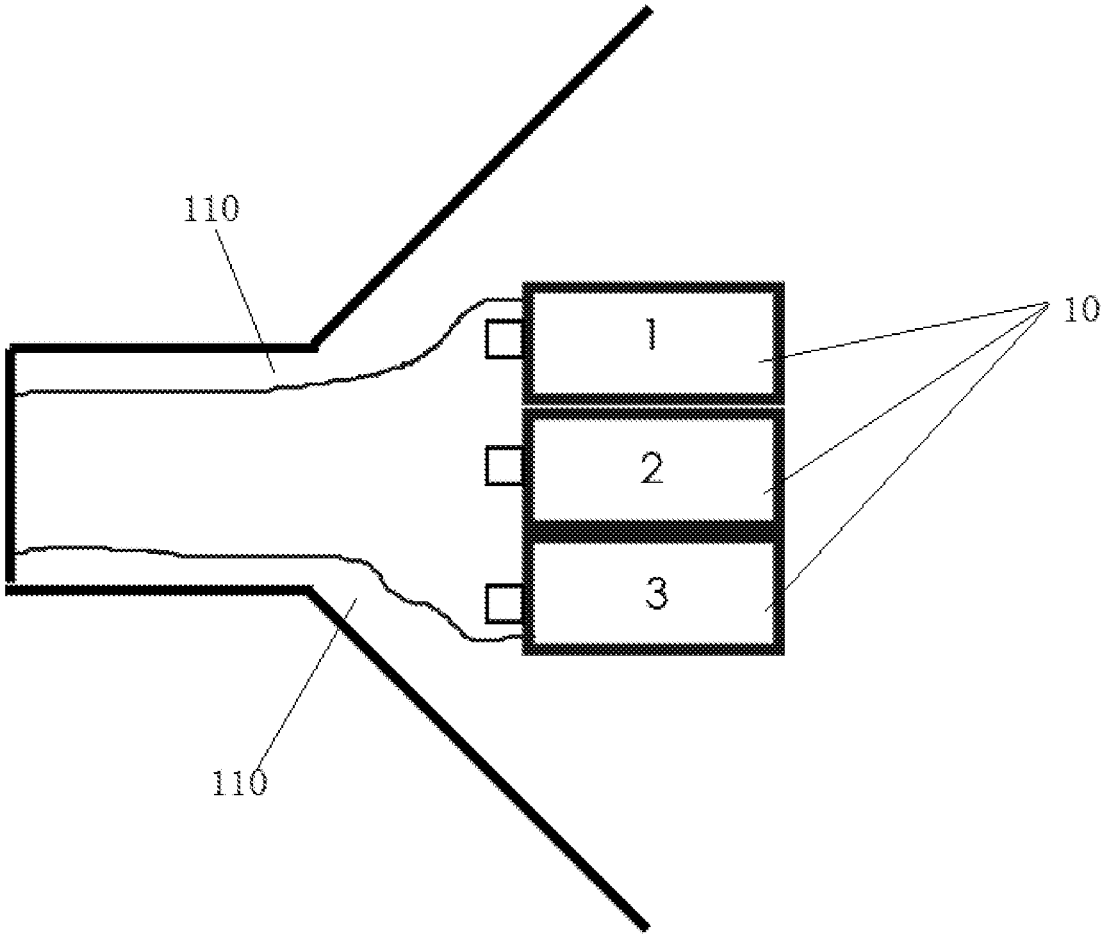
FIG. 2 shows a schematic diagram of the boundary structure of the inner structure of another headphone.
Figure 3:
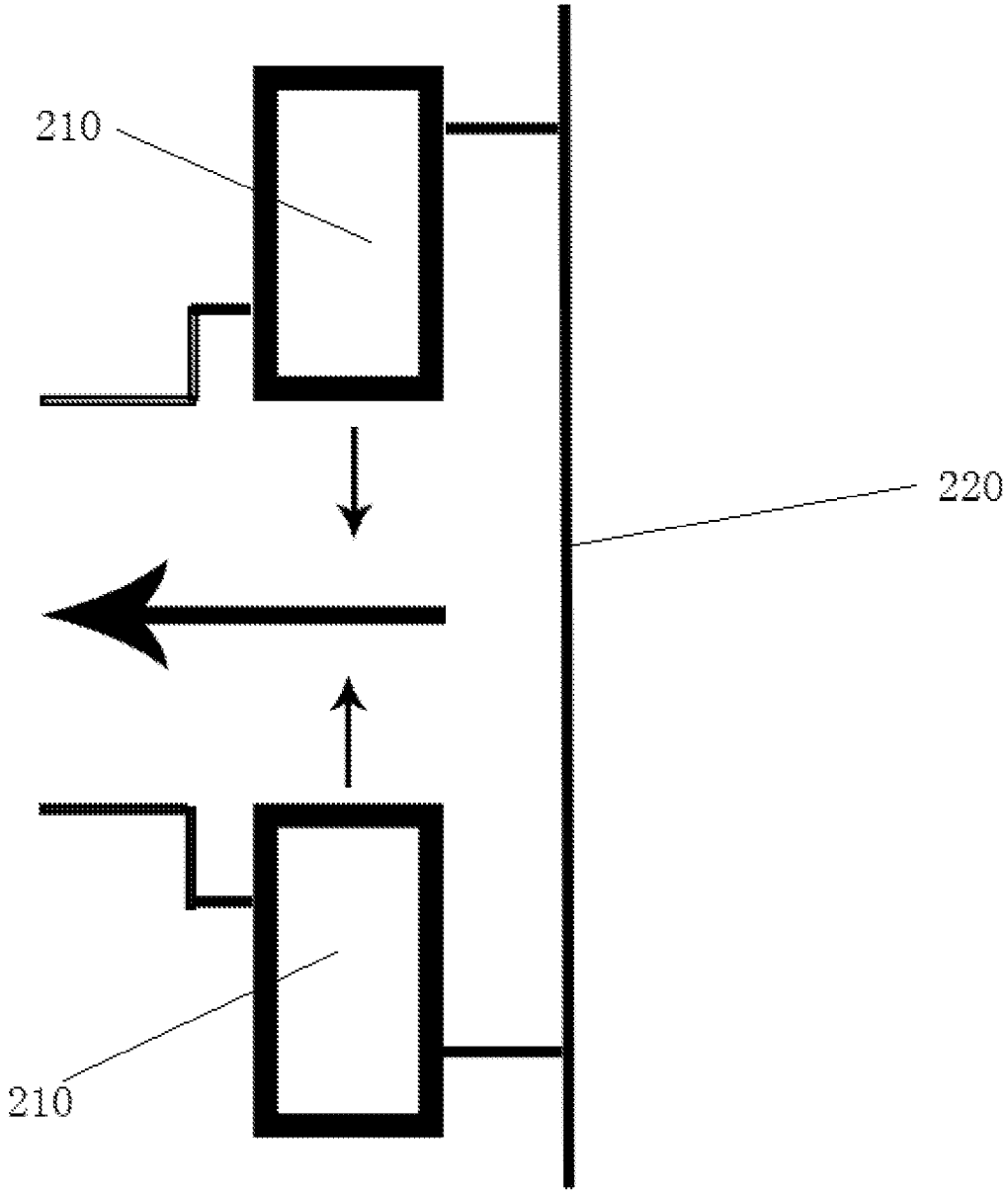
FIG. 3 shows a schematic diagram of the structure of the single-layer speaker units of the speaker bearing array sound-conducting structure of the present invention.
Figure 4:
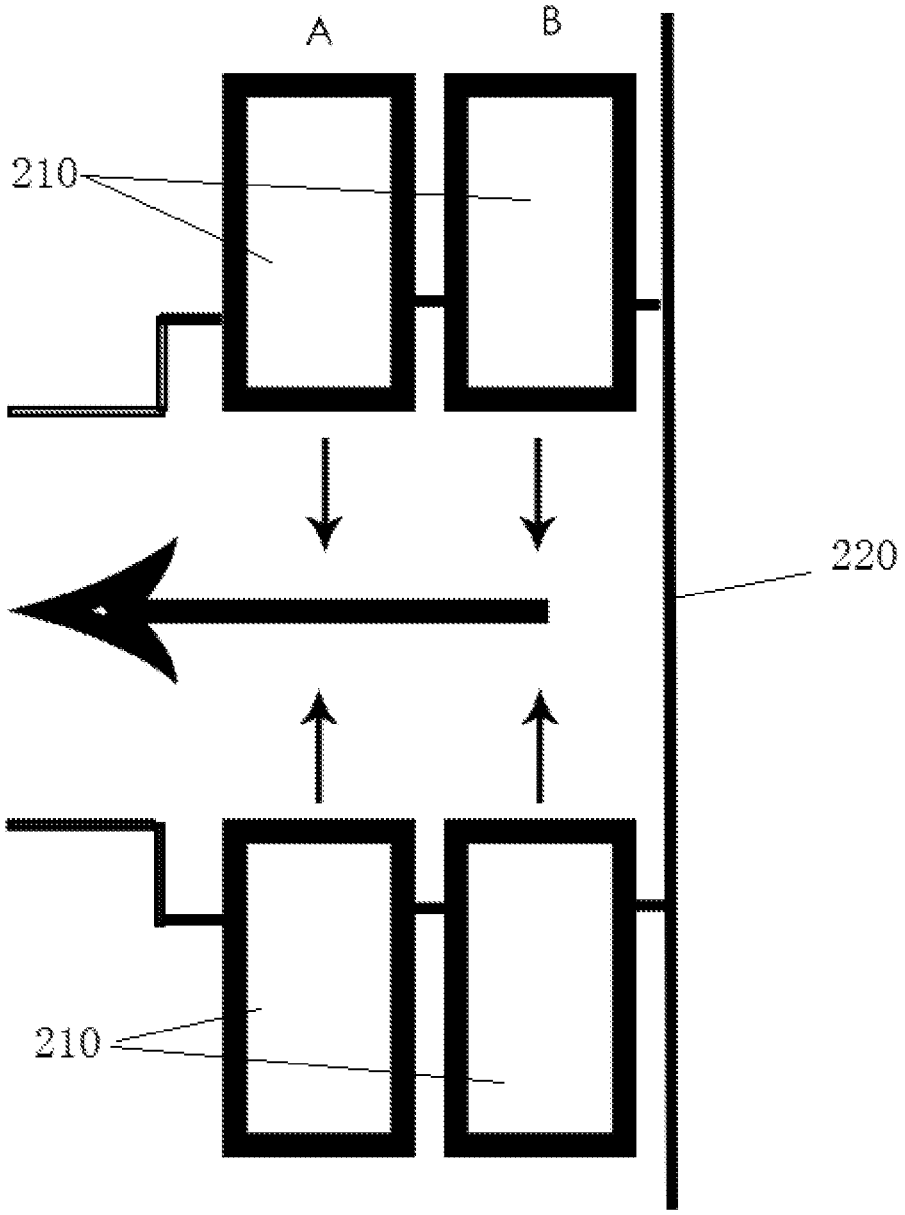
FIG. 4 shows a schematic diagram of the structure of the dual-layer speaker units of the speaker bearing array sound-conducting structure of the present invention.

FIGS. 3 and 4 and FIGS. 8 and 9 recite the speaker bearing array sound-conducting structure of an embodiment of the present invention, comprising a plurality of speaker units 210, a bearing 230, and a baffle 220. The speaker bearing array sound-conducting structure is disposed in a headphone to provide sound. The plurality of speaker units 210 are disposed in the front cavity of the headphone, can be designed to be a one-layer structure (as shown in FIG. 3), and can be designed to be a multilayer structure, as shown in FIG. 4, comprising a dual-layer structure with layers A and B.

The baffle 220 is disposed one side (such as the back side) of the plurality of speaker units 210 to control the conducting direction of sound. The speaker bearing array sound-conducting structure comprises the bearing 230, disposed in the center of the plurality of speaker units 210, such that the plurality of speaker units 210 are uniformly distributed around the bearing 230 centered about the bearing 230 on the same layer, so as to generate a middle channel that produces sound.

The speaker bearing array sound-conducting structure comprises a sound output opening, disposed in the front cavity, so as to fix the plurality of speaker units 210, and to concentrate the sound in the bearing and then conduct the sound outward. As shown in the arrows in the drawings, the sound produced by each speaker unit 210 is transmitted along the arrows in the drawings, and there is no loss in the transmission path.

Figure 5:
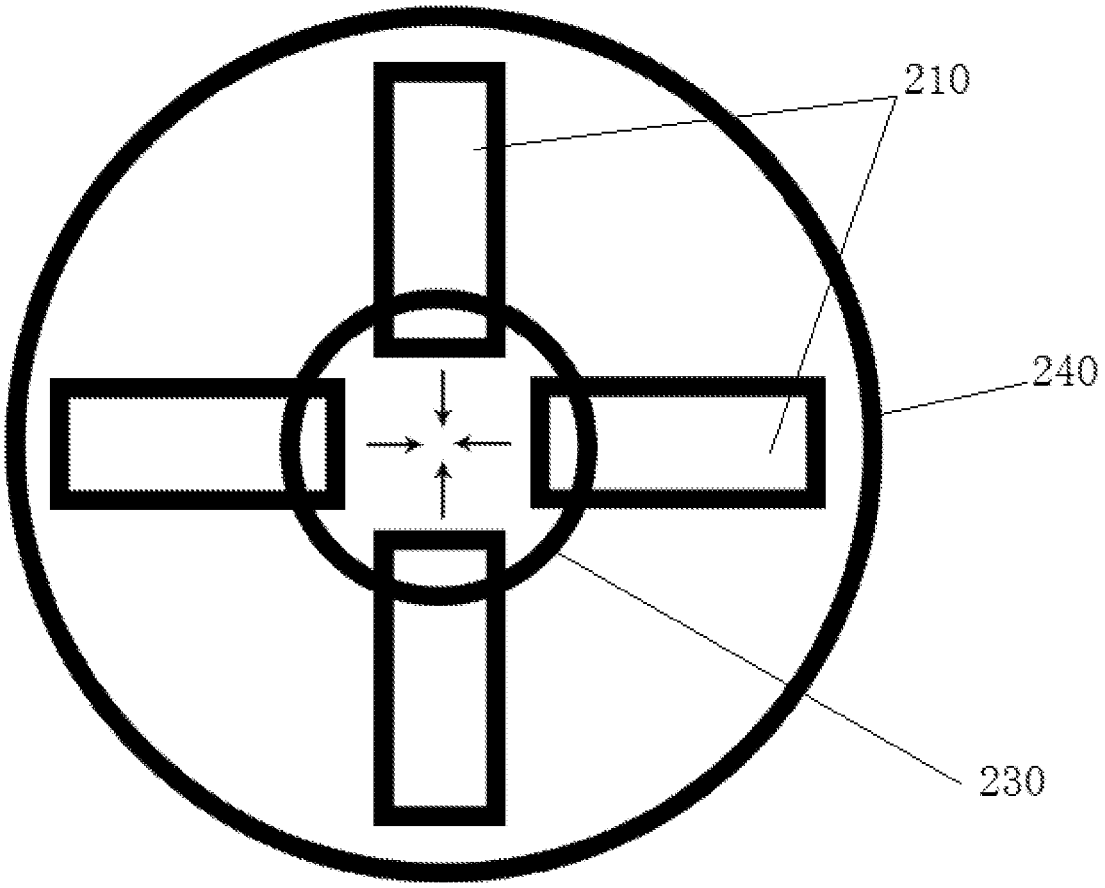
FIG. 5 shows a schematic diagram of the arrangement structure of four speaker units of the speaker bearing array sound-conducting structure of the present invention.
Figure 6:
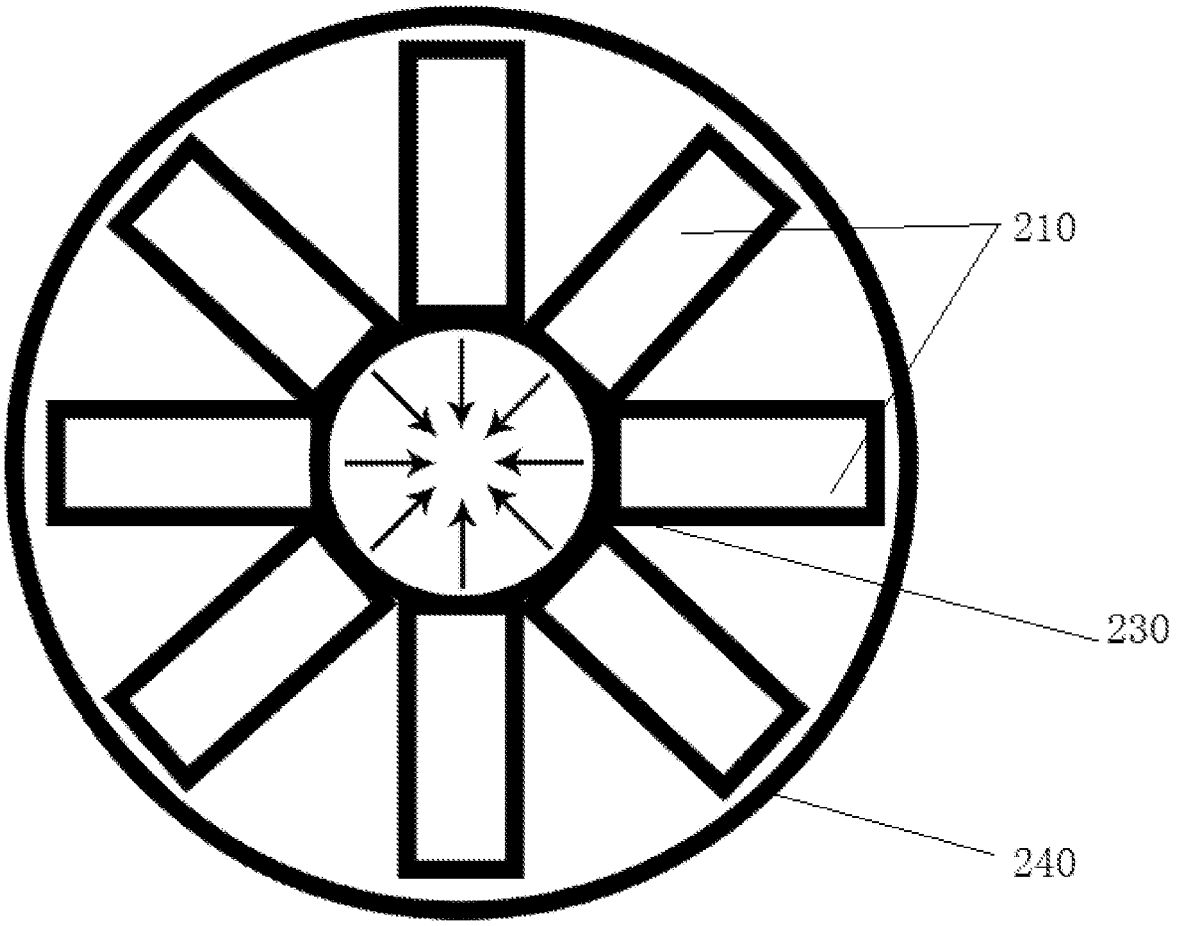
FIG. 6 shows a schematic diagram of the arrangement structure of eight speaker units of the speaker bearing array sound-conducting structure of the present invention.

As shown in FIG. 5, according to an embodiment of the speaker bearing array sound-conducting structure of the present invention, the number of the speaker units 210 is four, and the speaker units form a circle 240 centered about the bearing 230. As shown in FIG. 6, according to another embodiment of the speaker bearing array sound-conducting structure of the present invention, the number of the speaker units 210 is eight and the speaker units form a circle 240 centered about the bearing 230. Of course, the number of the speakers can be determined by rotation according to needs, so as to satisfy different requirements. Further, according to different arrangement forms of the plurality of speaker units 210, the plurality of speaker units 210 can be arranged in other forms, such as a quadrangle.

Further, according to the speaker bearing array sound-conducting structure of the present invention, the baffle 230 is disposed in a total-enclosed type or semi-enclosed type, so as to control the conducting direction of sound or the overall conducted sound strength or frequency integrity or to connect other external parts and structures.

Figure 7:
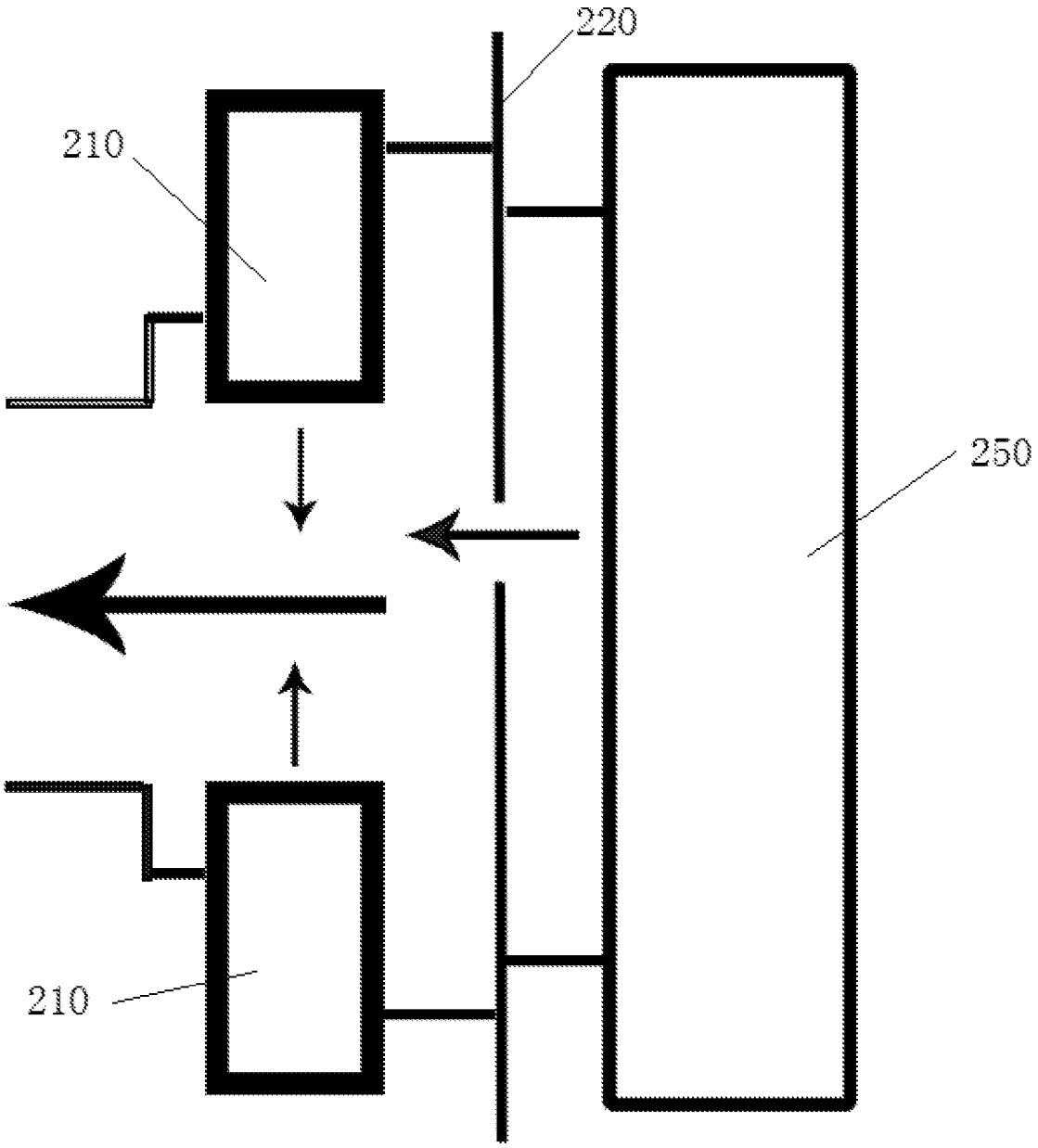
FIG. 7 shows a schematic diagram of the structure of the speaker bearing array sound-conducting structure of the present invention where a driver is increased.
Figure 8:
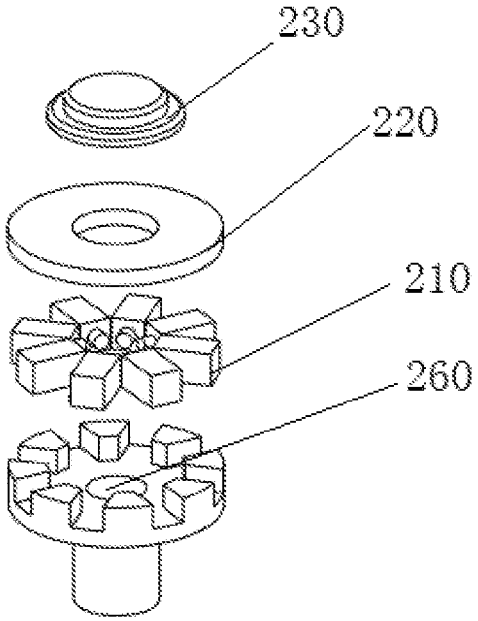
FIG. 8 shows a stereoscopic decomposition schematic diagram of the speaker bearing array sound-conducting structure of the present invention.
Figure 9:
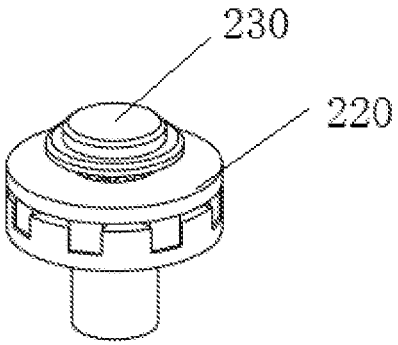
FIG. 9 shows a stereoscopic physical diagram of the speaker bearing array sound-conducting structure of the present invention.

As shown in FIG. 7, according to an embodiment of the speaker bearing array sound-conducting structure of the present invention, the speaker bearing array sound-conducting structure comprises a driver 250, disposed behind a back plate 220 to increase an additional driving force, so that the headphone obtains better sound quality.

In addition, the present invention also provides a headphone (not shown in the drawings). The headphone comprises a front cavity and a back cavity, wherein the headphone further comprises the speaker bearing array sound-conducting structure, so as to obtain sound having a consistent sound effect.

In conclusion, the speaker bearing array sound-conducting structure of the present invention uses a special bearing array arrangement approach. By means of the arrangement where the middle bearing is surrounded by the same layer of speakers, so as to generate a middle channel, in coordination with the sound output opening in front and the totally or partially closed baffle behind, the transmission channels of the speakers are created and controlled. The speakers share the bearing channel with the same size, and therefore, the transmission distances and spaces of all the speakers on the same layer are the same. The highest transmission efficiency and the best sound synchronization performance are achieved. The problems of different transmission distances, paths and efficiency of matrix arrangement and funnel shape with a wide upper part and a narrow lower part are solved. The problem of an effect on the sound transmission efficiency of individual or all speakers caused by different sizes and spaces of the independent pipelines of the individual speakers or the speaker groups during matrix arrangement is solved.

The embodiments above only show preferred implementations of the present invention, the description thereof is specific and detailed, but it cannot therefore be interpreted as a limitation of the patent scope of the present invention. It should be noted that several modifications and improvements can be made for persons skilled in the art, without departing from the conception of the present invention, such as combining different features in various embodiments, which all fall within the scope of protection of the present invention.

The invention claimed is:

1. A speaker bearing array sound-conducting structure, disposed in a headphone, wherein the speaker bearing array sound-conducting structure comprises:

a plurality of speaker units, disposed in a front cavity of the headphone;

a bearing, disposed in a center of the plurality of speaker units, such that the plurality of speaker units are uniformly distributed around the bearing centered about the bearing on the same layer, so as to generate a middle channel that produces sound;

a sound output opening, disposed in the front cavity, so as to fix the plurality of speaker units, and to concentrate the sound in the bearing and then conduct the sound outward; and a baffle, disposed behind the bearing, so as to control a conducting direction of the sound.

2. The speaker bearing array sound-conducting structure according to claim 1, wherein the baffle is disposed in a total-enclosed type or semi-enclosed type.

3. The speaker bearing array sound-conducting structure according to claim 1, wherein the plurality of speaker units are arranged quadrangularly or circularly.

4. The speaker bearing array sound-conducting structure according to claim 3, wherein the number of the speaker units is four or eight.

5. The speaker bearing array sound-conducting structure according to claim 1, wherein the speaker bearing array sound-conducting structure comprises a driver, disposed behind a back plate.

6. A headphone, comprising a front cavity and a back cavity, wherein the headphone comprises the speaker bearing array sound-conducting structure according to claim 1, so as to obtain sound having a consistent sound effect.

* * * * *